US005836377A

United States Patent [19]

Reichelt et al.

[11] Patent Number: 5,836,377

[45] Date of Patent: Nov. 17, 1998

[54] PROCESS AND DEVICE FOR COOLING MOLTEN STEEL

[75] Inventors: Wolfgang Reichelt; Ulrich Urlau, both of Moers; Paul Freier; Karl-Heinz Spitzer, both of Clausthal-Zellerfeld, all of Germany

[73] Assignee: Mannesmann Aktiengesellschaft, Düsseldorf, Germany

[21] Appl. No.: 702,503

[22] PCT Filed: Feb. 10, 1995

[86] PCT No.: PCT/DE95/00196

§ 371 Date: Oct. 3, 1996

§ 102(e) Date: Oct. 3, 1996

[87] PCT Pub. No.: WO95/23661

PCT Pub. Date: Sep. 8, 1995

[30] Foreign Application Priority Data

Mar. 4, 1994 [DE] Germany ..... 44 07 873.0

[51] Int. Cl.[6] ..... B22D 11/124; B22D 11/06

[52] U.S. Cl. ..... 164/486; 164/475; 164/479; 164/414; 164/429; 164/444

[58] Field of Search ..... 164/479, 429, 164/486, 444, 415, 475, 455, 414, 481, 431

[56] References Cited

U.S. PATENT DOCUMENTS 5,299,628 4/1994 Ashok ..... 164/479

FOREIGN PATENT DOCUMENTS 167921 1/1986 European Pat. Off. ..... 164/486
59-150646 8/1984 Japan ..... 164/479
61-1038747 2/1986 Japan .

*Primary Examiner*—Patrick Ryan
*Assistant Examiner*—I.-H. Lin
*Attorney, Agent, or Firm*—Cohen, Pontani, Lieberman & Pavane

[57] ABSTRACT

A process for cooling molten steel, in particular by continuous casting of hoop-steel. At least part of the molten mass that leaves a metallurgical vessel through a metal nozzle solidifies when contacting a cooling surface. A gaseous stream that forms a reducing atmosphere is directed onto the surface of the freely accessible liquid hoop-steel immediately after it leaves the metal nozzle and the surface of the hoop-steel is exposed to this gaseous atmosphere at least until it is completely solidified.

17 Claims, 2 Drawing Sheets

PROCESS AND DEVICE FOR COOLING MOLTEN STEEL

FIELD OF THE INVENTION

The present invention relates to a process an apparatus for cooling molten steel, particularly continuous casting, in which at least a portion of the molten metal that emerges from a nozzle of a metallurgical vessel is solidified by means of contact with a cooling surface.

BACKGROUND OF THE INVENTION

In continuous or strand casting, the molten metal is directed into a cooled mold. Contact with the cooling mold causes a solidification front to form, beginning at the outside and moving toward the interior of the strand. In order to improve the quality of the metal blanks, it is known to supply them with an inert gas.

For example, German Patent Publication DE OS 21 63 928 proposes that during the production of steel blanks by means of the continuous casting of a metal stream into a cooled mold, an inert gas be introduced over the metal at the upper part of the mold in the vicinity of the surface of the molten metal. The use of nitrogen or argon that has previously been liquified by compression and lowered temperature, which is applied in liquified state to the surface of the steel blanks, is suggested. The aforementioned document merely discloses exposing the molten metal to an inert gaseous atmosphere and directing the gaseous jet in such a way that the molten metal of the blanks is offset around a vertical axis in a rotational movement.

From German Patent Publication DE 32 27 132 A1, it is known to surround a metal stream that emerges from a metering nozzle with a protective mantle of inert gas, e.g.; argon or nitrogen, in order to keep air away from the vicinity of the metal melt. This pressurized inert gas screens off the oxygen coming from the ambient air and in this way prevents reoxidation of the exposed metal melt meniscus. The expert in this document does not undertake more extensive influencing of the molten metal. Furthermore, the use of inert gas to treat metal strands or wires that are solidified already or only heated is known. For example, in German Patent Publication DE 35 06 597A1 a wire is exposed to a lightly reducing gas in the housing of a cooling column. The gas used in this case is supplied to the housing in an undirected fashion and serves exclusively to cool and, usually, to reduce scale formation. In the cited casting processes, the inert gas is brought into contact with the molten or the already solidified surface. In the case of continuous casting as known from German Patent Publication DE 38 10 302, for example, the molten metal is deposited on a cooled continuous belt and the exposed surface of the strand cools during its transport on the belt, so that the exposed surface in the front area near the nozzle is still molten and solidifies later due to cooling.

SUMMARY OF THE INVENTION

An object of the invention is to create a process and a corresponding device that can influence the surface of a continuously cast metal strand in respect to both its form and its quality.

According to the invention, a gaseous stream is directed onto the surface of a freely accessible molten steel strand directly after the latter emerges from a metal nozzle of a metallurgical vessel. The surface of the strand is thereby exposed to a gas that forms an inert atmosphere at least until the steel strand solidifies completely. Along with gases low in oxygen, e.g. flue gas, inert gases such as argon or nitrogen, in particular, can be used.

The use of these gases intensely influences the surface of the steel strand; specifically, in the molten area as well as in the solidified area and the area of molten/solid transition. As a result, scaling is avoided. Furthermore, using the gas in the vicinity of the nozzle allows deliberate influence to be exercised on the heat extraction and surface tension. Depending on the desired quality of the steel strand or steel strip, the inventors propose to either heat the gas and in this way prevent solidification of the strand surface for a predeterminable segment or, in another embodiment, to cool the gas to such an extent that it is transported in liquid form. The temperature of the gas can be established in either of the two extreme ranges in predeterminable fashion. Of course, the gas can also be used at room temperature.

In an advantageous further embodiment of the invention, is; the gas directed onto the surface of the steel strand not only at a temperature, but also in a quantity and at a speed that permit influence to be exercised on the form of the cast strand. First, the surface can be deliberately pressed upon and the entire strand, for example, given a profile in the form of a camber. However, it is also possible to direct the gas in such a way that the gaseous kinetics have a complementary positive influence in reducing bulge formation.

DETAILED DESCRIPTION OF THE PRESENTLY PREFERRED EMBODIMENTS

Figure 1:
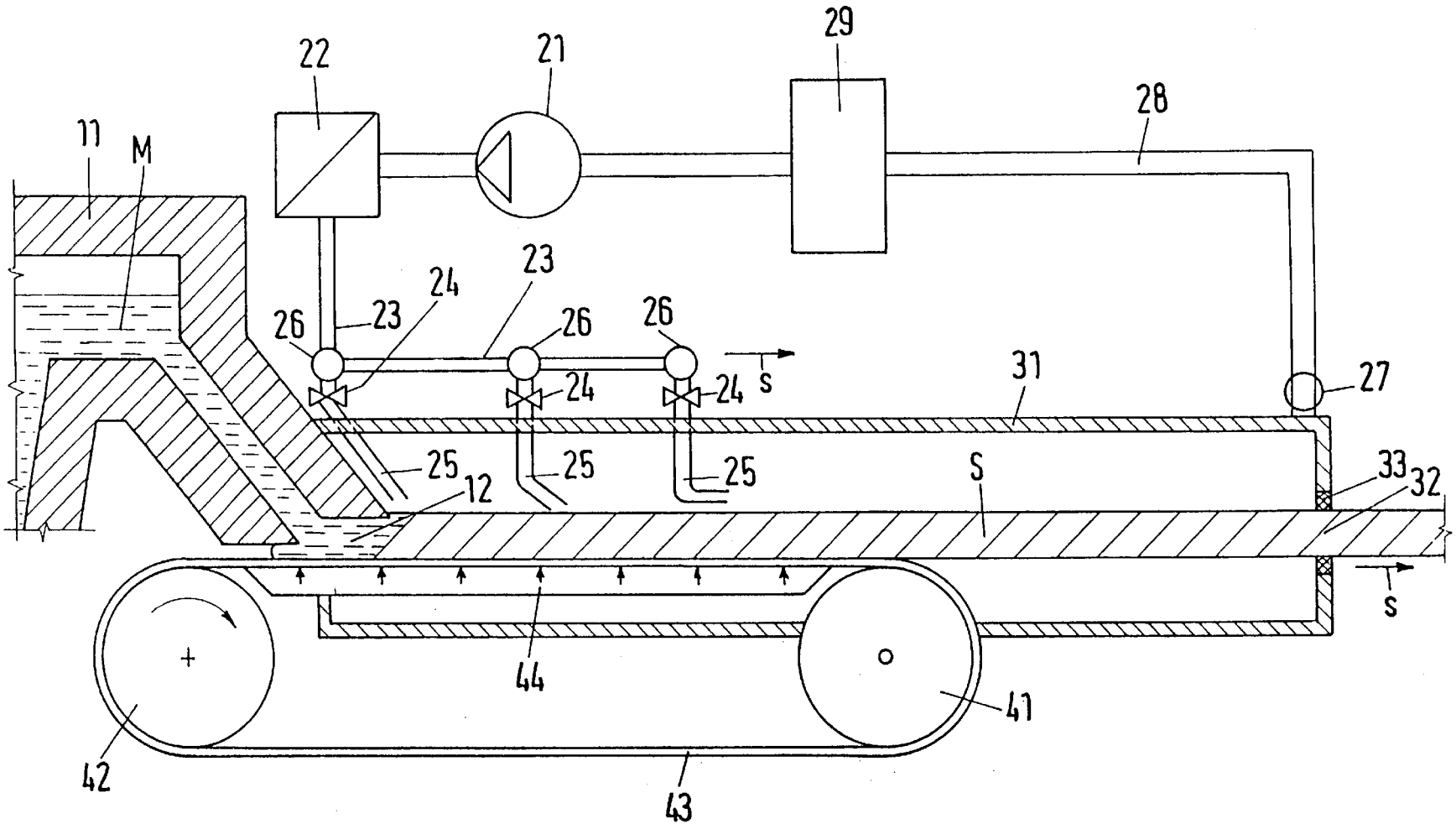
FIG. 1 Schematically shows; a longitudinal section through the casting unit.

FIG. 1 shows a metallurgical vessel 11, wherein a metal melt M flows out of a metal nozzle 12.

The melt M is directed onto a transport belt 43, which is held as a continuous belt by a driving drum 41 and a guiding drum 42. On the underside of the carrying run of the transport belt 43, there is a cooling device 44 that cools the steel strand S, which is transported in the transport direction s.

The metal strand S is surrounded by a housing 31, which surrounds the strand S at the exit 32 by a seal 33 in order to minimize gas leakage.

Gas nozzles 25 are run through the cover of the housing 31. These gas nozzles 25 are arranged at an angle of between 0° and 45° relative to the steel strand S. The nozzles 25 are attached to gas distributors 26, which are connected to a compressor 21 via the supply lines 23. The gas nozzles 25 can be individually blocked by the blocking organs 24.

Between the compressor 21 and the nozzles 25, there is a heat exchanger 22, which can be used to adjust the temperature of the gas that forms the reducing atmosphere or the temperature of the inert gas in predeterminable fashion. The compressor 21 is attached to a gas supply station 29. FIG. 1 shows a connecting line 28 that connects the gas supply station 29 to the housing 31 in the area of the strand exit 32 via a collective gas line 27.

Figure 2:
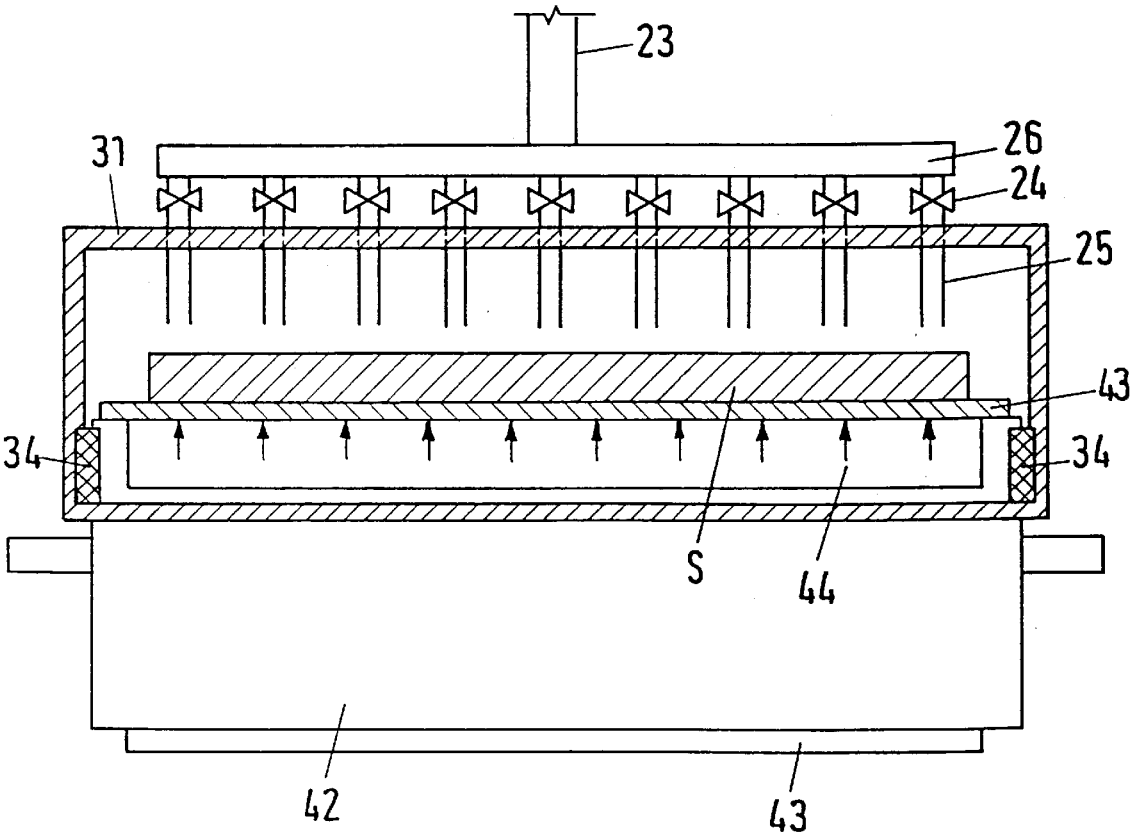
FIG. 2 Schematically shows; a cross-section.

Using the same item numbers as FIG. 1, FIG. 2 shows a cross-section through a continuous casting unit. FIG. 2 shows the arrangement of several gas nozzles 25 next to one another, each of which has a blocking organ 24 and is attached to the distributor 26, which has the supply line 23.

In the upper area of the guiding drum 42, there is a seal 34, which minimizes leakages between the side walls of the housing 31 and the side shields of the drum 42.

We claim:

1. A process for cooling molten steel, in which at least a portion of a melt emerging from a metal nozzle of a metallurgical vessel is solidified by contacting a cooling surface, said process comprising the following steps:

blowing a gas through a gas nozzle onto a surface of a freely accessible molten steel strand having a predetermined cross-section as it emerges from the metal nozzle, wherein the gas nozzle is oriented at an angle of between 0° and 45° relative to a plane defined by the strand and the directed gas is of a quantity and speed so as to impact upon the surface of the strand and reduce the cross-section of the strand;

forming a reducing atmosphere on the surface of the strand; and exposing the strand to the reducing atmosphere at least until solidification is complete.

2. The process for cooling molten steel in claim 1, wherein the gas is an inert gas.

3. The process for cooling molten steel in claim 1, further comprising the step of setting a temperature of the gas prior to directing the gas.

4. The process for cooling molten steel in claim 3, wherein the step of setting the temperature comprises heating the gas to a temperature that prevents solidification of the strand surface for a period of time.

5. The process for cooling molten steel in claim 4, wherein the heated gas is applied to the strand surface in a direction which is the same as a transport direction of the steel strand and in an area in which a solidification front, beginning on an opposite side of the strand to which the gas is being directed, has not yet penetrated through a width of the strand.

6. The process for cooling molten steel in claim 3, wherein the step of setting the temperature comprises cooling the gas until it reaches liquid form.

7. The process for cooling molten steel in claim 6, wherein the gas is directed onto the stand so that its gaseous kinetics have a complementary positive influence in reducing bulge formation and at an angle of less than 10 degrees from a plane defined by the steel stand.

8. The process for cooling molten steel in claim 1, further comprising the step of controlling speed and pressure profile of the gas to produce a stream perpendicular in direction to a transport direction of the steel strand.

9. The process for cooling molten steel in claim 8, wherein the gas is directed and controlled such that the steel strand forms a camber.

10. An apparatus for cooling molten steel, in which at least a portion of a melt emerging from a metal nozzle of a metallurgical vessel is solidified by contacting a cooling surface, comprising:

a housing for enclosing a steel strand therein at least until solidification is complete, said housing having an opening at one end for receiving the melt immediately as it emerges from the nozzle and a strand exit at an opposite end with sealing means at both the opening and exit;

a transport belt partially enclosed by said housing and having an upperside and an underside, wherein said upperside of said transport belt supports the melt as it exits from the nozzle and advances the steel strand through the housing;

a cooling device in contact with the underside of said transport belt; and means for directing a gas onto a surface of the steel strand, wherein said directing means is enclosed in said housing and positioned at an angle between 0 and 45 degrees relative to a plane defined by the steel strand; and a gas supply station connected to said means for directing the gas.

11. The apparatus for cooling molten steel in claim 10, wherein the strand has a predetermined cross-section and the gas is of such quantity and speed as to impact upon the surface of the stand and reduce the cross-section of the strand.

12. The apparatus for cooling molten steel in claim 10, wherein said means for directing the gas comprises at least one gas nozzle.

13. The apparatus for cooling molten steel in claim 12 wherein a number and arrangement of the at least one gas nozzle in a transport direction of the steel strand and in a breadth direction of the steel strand is dependent upon at least one of a desired gas volume and a gas exit speed onto the steel strand.

14. The apparatus for cooling molten steel in claim 13, wherein the at least one gas nozzle is arranged in the same direction as the transport direction of the steel strand and parallel to the nozzle in an immediate vicinity thereof.

15. The apparatus for cooling molten steel in claim 14, further comprising a heat exchanger connected between the at least one gas nozzle and said gas supply station.

16. The apparatus for cooling molten steel in claim 15, further comprising a compressor connected between said heat exchanger and said gas supply station.

17. The apparatus for cooling molten steel in claim 16, further comprising a collective gas line attached to the strand exit end of said housing and connected to said gas supply station.

* * * * *